United States Patent [19]

Andersson

[11] 4,015,357

[45] Apr. 5, 1977

[54] FIREARM BOLT

[76] Inventor: Lars Ake Vilhelm Andersson, Sandstensvagen 71, S-136 51 Handen, Sweden

[22] Filed: Aug. 11, 1975

[21] Appl. No.: 603,684

[30] Foreign Application Priority Data

Aug. 13, 1974 Sweden ..... 7410321

[52] U.S. Cl. ..... 42/16

[51] Int. Cl.[2] ..... F41C 11/00

[58] Field of Search ..... 42/16

[56] References Cited

UNITED STATES PATENTS

| | | | |
|---|---|---|---|
| 1,209,872 | 12/1916 | Nelson | 42/16 |
| 2,543,604 | 2/1951 | Singer | 42/16 |
| 3,013,355 | 12/1961 | Weatherby | 42/16 |
| 3,274,724 | 9/1966 | Brandt | 42/16 |
| 3,330,061 | 7/1967 | Koon, Jr. | 42/16 |
| 3,387,400 | 6/1968 | Badali et al. | 42/16 |
| 3,755,947 | 9/1973 | Koon, Jr. | 42/16 |

FOREIGN PATENTS OR APPLICATIONS

| | | | |
|---|---|---|---|
| 137,617 | 1/1920 | United Kingdom | 42/16 |

*Primary Examiner*—Charles T. Jordan
*Attorney, Agent, or Firm*—Young & Thompson

[57] ABSTRACT

The invention relates to a bolt for a firearm, and in particular a bolt for a rifle with bolt action loading, comprising a bolt body having a central bore which comprises in its front part a bolt head with latches and in its rear part a searing head with an aperture for guiding a projection secured to a nut which is detachably fixed to a striker rod, and a bore for detachably inserting a bolt lever, the bolt body including its head, the latches and the searing head being made from a single solid piece of metal.

3 Claims, 2 Drawing Figures

FIREARM BOLT

Figure 1:
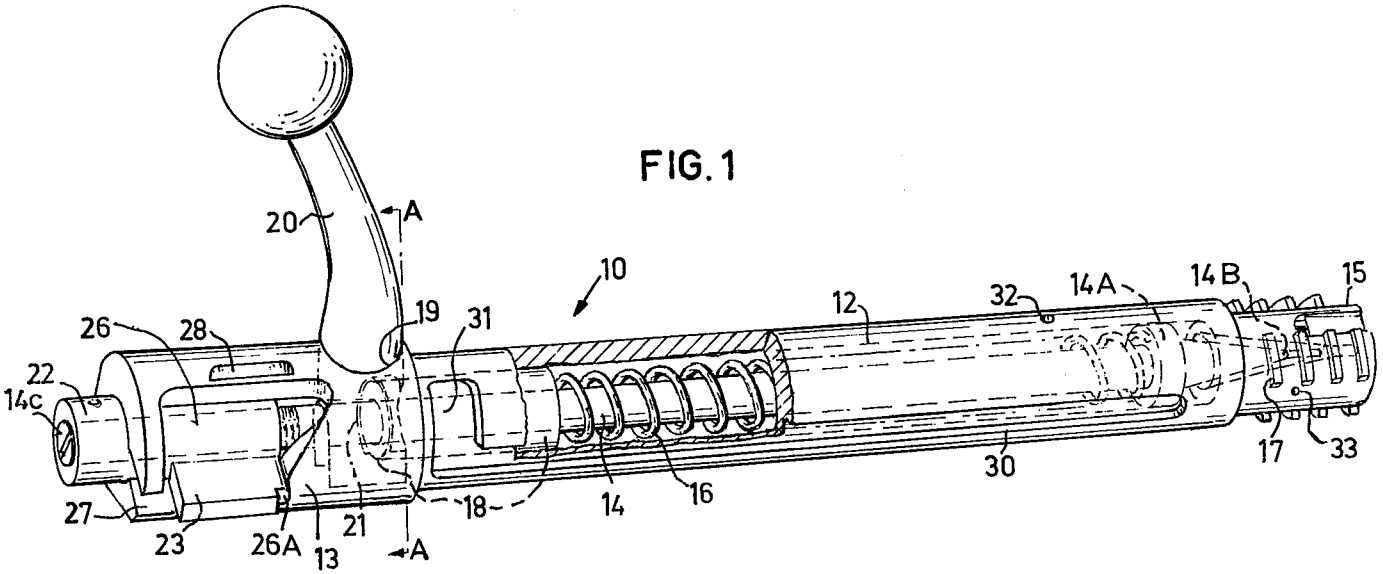

The present invention relates to a bolt for a firearm, and in particular a bolt for a rifle with a bolt action.

The bolt of such a rifle should fulfill certain basic tasks. It must effectively enclose a cartridge in the chamber and, during firing, support and seal the rear part and bottom of the cartridge to prevent breakage of the cartridge and at the same time transfer the axial force of the gas pressure to the receiver. The bold must contain all necessary parts for firing, i.e. , usually a striker rod with a coil spring acting thereon and a searing head for locking of the striker rod in firing position. After firing the bolt shall provide for the release of the empty case from the chamber where it is tightly fitted against the chamber wall by the gas pressure during firing. In guns for powerful cartridges the enclosure of the cartridge and the release of the case is provided for by latches in the shape of heavy screwthreads which are axially insertable for cooperation with corresponding female parts in the receiver and then rotatable for locking or opening of the action around the cartridge or the case, respectively. The number of latches may be two or three powerful latches distributed along the length of the bolt, or a plurality of small latches around the bolt head providing a so-called artillery bolt with threads partly cut off along three or four sectors. To open and close the action there is a lever with a bolt handle. For the extraction of the empty case there is further an extractor having a claw arranged to grip around the rim of the shell, and an ejector. The ejector may be in the form of a projection from the receiver, against which the rim of the case abuts during extraction, or consist of a small pin in the bolt head which, by means of a coil spring, is pressed against the case bottom.

Bolt actions employing the above-mentioned functions and devices have been in use since about 1860 when such arms were hand-manufactured by gunsmiths relying on much older traditions. The gunsmith traditions were included in mass production of army rifles and hunting rifles and even today, many industrially manufactured rifles made in automatic equipment carry many features from those days when their design depended on how they were best made by skilled master gunsmiths. Hunting rifles in particular preserve many oldfashioned features in their design.

Thus, the bolt of many army rifles and hunting rifles is made up of unnecessarily numerous parts and employs a design which is not very useful for modern, industrial manufacturing. As a consequence, many bolt actions which reasonably fulfill set-up demands on reliability, are more expensive than otherwise needed.

The present invention relates to a bolt of a corresponding bolt action of extremely simple design which is particularly well-adapted for manufacture using modern, automatic machinery, the bolt according to the invention fulfilling the highest demands on functional reliability and, at the same time, being possible to manufacture at a much lower cost than known bolts.

Figure 2:
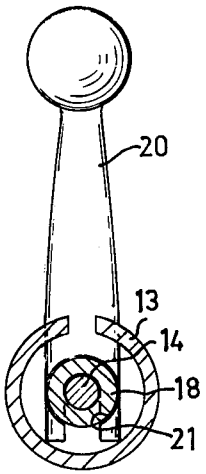

The invention will be described in the following with reference to the enclosed drawing, in which FIG. 1 from below shows in perspective a partly cut away view of an embodiment of a bolt according to the invention and FIG. 2 shows a section through the bolt along the line A—A of FIG. 1.

The bolt 10 in FIG. 1 comprises one mainly cylindrical, straight and hollow body 12, the front end of which is shaped like a locking head 15 with latches 17. The latches 17 are suitably shaped as threads which are symmetrically cut off along four sectors, each thread having suitably a trapezoidal shape. When the bolt 10 is inserted into the receiver (not shown) of the arm, the bolt head 15 encounters a mating arrangement in the front part of the receiver, the latches 17 being free to slide onwards due to the fact that the threads of the receiver are correspondingly cut away. When the bolt 10 is rotated one quarter of a turn for closing and locking of the cartridge chamber, the latches 17 engage in the corresponding tracks of the receiver, by means of which action the whole of the bolt is primarily screwed forward towards the rear wall of the cartridge chamber and finally, in a well-known manner, abuts against this wall.

At the front end of the bolt head there is, in a known manner, a cylindrical, central bore which engages around the rear part of the case when the action is closed, and a coaxial, small bore for a striker head **14*b*. An extractor and an ejector, both of a suitable kind well-known to anyone skilled in the art, are arranged opposite each other in the bolt head 15** for extraction of the empty cartridge case.

The external diameters of the bolt head 15 and the body 12 may be equal, while the rear part of the body 12 abruptly widens to a searing head 13 in which a bolt handle 20 is detachably mounted by means of a cylindrical body 18 provided with a central bore which is arranged in the bore of the body 12. The external diameter of the body 18 provides for a slidable fit in the bore of the body 12 and its central bore provides for a slidable fit for a striker rod 14.

The striker rod 14 extends through the whole length of the bolt 10, and it is shaped as a cylindrical rod of hard material which at its front end comprises a striker head **14*a* which guides the striker rod 14 in the bore of the bolt and further serves as an abutment for a coil spring 16, the rear end of which abuts against the body 18. The striker head 14*a* extends forwardly in a striker pin 14*b* which in its forward position extends about 1 mm beyond the front face of the bolt head 15**.

As already described, the striker rod is slidably arranged in the body 18, the rear part of which is arranged in a corresponding, cylindrical bore in the inserted part of the bolt lever 20 which also comprises a slot along its length (see FIG. 2) of slightly greater width than the diameter of the striker rod 14 which makes it possible to mount the bolt lever 20 after insertion of the striker rod 14, the coil spring 16 and the body 18 into the bolt body 12. When performing this operation, a suitable tool is used to press the body 18 against the coil spring 16 until the body 18 provides free passage for insertion of the lever 20 into a corresponding bore 19 in the searing head 13. When the lever 20 has reached its predetermined, inserted position in the body 12, the afore-mentioned bore of the lever 20 is situated opposite the body 18 which is then pushed by the coil spring 16 into the bore, thus locking the position of the lever 20. Its disassembly is arranged vice versa, that is, by a tool pressing against the body 18 and the coil spring 16 until the lever 20 can be pulled out, upon which the body 18, the coil spring 16 and the striker rod 14 can easily be extracted from the bolt.

The rear part of the striker rod 14 is threaded and provided with a slit **14*c* or functionally similar means at its rear end which, in combination with a corresponding tool, for example a screwdriver, permits screwing of the striker rod into a nut 22 with a corresponding, threaded bore. The nut 22 is essentially a cylindrical body which is slidable and within a limited angle, rotatable inside the searing head 13 at the rear of the bolt 12. The nut 22 comprises a radially and longitudinally extending projection 23 which is insertable into an aperture 26 in the mantle of the searing head 13 through a slot 27 in the mantle and rear wall of the searing head 13.**

The front wall or delimitation in the mantle of the aperture 26 is set at an angle against the axis of the bolt.

When the bolt is assembled in the receiver of the arm, the projection 23 is prevented by a corresponding tract in the receiver from rotating relative to the receiver. When the bolt 10 is, by means of the lever or bolt handle 20, turned for opening of the cartridge chamber of the fire arm, the oblique front wall of the aperture 26 forces the projection 23 backwards relative to the searing headd, whereby the striker pin **14*b* is withdrawn into the head 15 and the spring coil 16 becomes loaded. In this position, the front edge of the projection 23 will come to rest in a step 26*a* of corresponding shape, which permits the bolt 10 to be removed from the receiver having its coil spring 16** loaded.

After loading of the coil spring 16 in the above fashion, a trigger bar (not shown) engages in the receiver and retains the projection 23 in its rearward position when the bolt for reloading is pushed forward under rotation and thus locks the cartridge chamber. For firing, the trigger bar is pulled downwards so that the projection 23 is liberated to move forwards. Safety against firing is provided by locking the trigger bar and, in the shown embodiment, the searing head 13 comprises a cavity 28 for the accessible part of the safety catch (not shown).

To guide the bolt, especially during pushing of the bolt forward in the receiver for loading, in order that the latches 17 automatically stay out of contact with the corresponding latches of the receiver, the bolt 20 comprises a track 30 which runs along part of the length of the bolt 12 and which is normally directed downwards, into which a corresponding guiding pin of the receiver is insertable. The guiding pin in cooperation with the guiding track 30 thus prevents any rotation of the bolt until the bolt has been pushed forward so far that closing by means of the latches 17 entering the corresponding threads of the receiver is apt to begin. For this means the rear part of the track 30 widens to a turning track 31 of such width that rotating of the bolt to closed position can be carried out.

To prevent hot gas from an imperfect cartridge from leaking out through aperture 26 or the slot 27, the bolt may be provided with gas outlets 32,33, conveniently at its front part, connecting the cavity of the bolt with the atmosphere.

As the bolt in front of the bolt lever 20 is preferably perfectly cylindrical, the searing head 13 may be entirely cylindrical or provided with decorative facets along its upper part. This upper part may also be serrated or treated in another or similar fashion in order that the surface reflect less light, or for its decoration.

What I claim is:

1. A bolt for a firearm, especially a rifle with bolt action loading having a receiver for the bolt, comprising a bolt body having a central bore, a striker rod slidably and rotatably mounted in said bore, a coil spring urging the striker rod forwardly, a nut detachably fastened to the rear end of the striker rod, a radial projection extending from said nut, said bolt body having a front part which comprises a bolt head with latches and a rear part which comprises a searing head with an aperture for guiding the radial projection from the nut on the rear end of the striker rod, a bolt lever detachably inserted in a sideways facing bore in said searing head, characterized in that the innermost part of the bolt lever is forked so as to embrace the striker rod on being inserted in the sideways facing bore, the front face of the forked part of the lever further having a cylindrical cavity and a cylindrical hollow body urged by the coil spring abutting its forward end face to press the rear portion of the cylindrical body into the cylindrical cavity, thus interlocking the bolt lever in its inserted position.

2. A bolt according to claim 1, characterized in that the rear part of the striker rod is threaded for screwing into corresponding internal threading of the nut, the radial projection of the nut being insertable into the aperture through a radially directed slot in the searing head.

3. A bolt according to claim 1, characterized in that the bolt body comprises an external, longitudinal track for guiding of the bolt in cooperation with a corresponding pin of the receiver during sliding of the bolt therein, the rearmost part of the track having greater width to permit rotation of the bolt for opening or closing of the bolt action.

* * * * *